US008458945B2

(12) United States Patent
Washam, Jr.

(10) Patent No.: US 8,458,945 B2
(45) Date of Patent: Jun. 11, 2013

(54) ONE PIECE PROGRESSIVE BORE MULTI-STAGED SHOTGUN CHOKE SYSTEM

(76) Inventor: Jimmy Washam, Jr., Hazlehurst, GA (US)

( * ) Notice: Subject to any disclaimer, the term of this patent is extended or adjusted under 35 U.S.C. 154(b) by 0 days.

(21) Appl. No.: 13/069,114

(22) Filed: Mar. 22, 2011

(65) Prior Publication Data

US 2012/0240443 A1 Sep. 27, 2012

(51) Int. Cl.
*F41A 21/40* (2006.01)

(52) U.S. Cl.
USPC ..... 42/79

(58) Field of Classification Search
USPC ..... 42/79
See application file for complete search history.

(56) References Cited

U.S. PATENT DOCUMENTS 833,484 A * 10/1906 Robedee ..... 42/79
3,161,979 A 12/1964 Lowe
4,058,925 A * 11/1977 Linde et al. ..... 42/79
5,249,385 A * 10/1993 Vang et al. ..... 42/79
5,272,827 A * 12/1993 Vang et al. ..... 42/79
5,394,634 A * 3/1995 Vang et al. ..... 42/79
5,452,535 A 9/1995 See et al.
6,052,935 A 4/2000 Howard
6,289,620 B1 * 9/2001 Doria ..... 42/79
6,789,343 B1 9/2004 Dietrich et al.
2005/0011102 A1 * 1/2005 Boyer ..... 42/79
2008/0173166 A1 * 7/2008 Andry ..... 89/14.3

* cited by examiner

*Primary Examiner* — Jonathan C Weber

(57) ABSTRACT

A shotgun choke system consisting of four zones, a the first zone being a compression or constriction zone; the second zone being a stabilization zone; the third zone being a second compression or constriction zone; and the forth and final zone being a second stabilization zone. The shot package is compressed and constricted into a tight, uniform shot delivery package, and the wad package is completely separated from the shot package. The shot package therefore leaves the barrel of the choke, first, while gasses from the shot escape through a muzzle break and the wad package exits following the shot package, drastically reducing recoil and improving the shot pattern over prior art choke embodiments.

3 Claims, 2 Drawing Sheets

ONE PIECE PROGRESSIVE BORE MULTI-STAGED SHOTGUN CHOKE SYSTEM

BACKGROUND OF THE INVENTION

1. Field of the Technology

This invention relates to the field of shot pattern controlling devices for mounting or otherwise connected to a barrel of a shotgun. More particularly, the invention relates to a novel choke for shotguns and other firearms that fire a shot package rather than a single bullet.

2. Background

It is known in the art to provide a choke system to attach to a shotgun barrel in order to change the dispersion and distribution of shot or pellets emanating from the muzzle of a shotgun. Such prior art apparatus include those such that are disclosed in U.S. Pat. Nos. 3,161,979, 6,052,935, 5,452,535, and the prior art patents cited therein.

A shotgun choke is a constriction device or apparatus mounted on or incorporated into the muzzle of a shotgun barrel that changes the patterning characteristics of a shot charge onto its target. A choke may also be incorporated into a shotgun barrel and is not required to be a second or separate attachment or apparatus. A choke can be any device or configuration that restricts, stacks, organizes, and compresses the shot package of a typical shotgun shell.

Many prior art shotgun chokes or restrictors have moving parts or do not substantially restrict the shot to an improvement over other chokes. Many prior art shotgun chokes do not provide the joint benefits of pattern placement and recoil reduction.

SUMMARY OF THE INVENTION

An embodiment of the invention may be a shotgun choke system comprising: a first compression zone; a first stabilization zone; a second compression zone; a second stabilization zone; and a muzzle break.

A further embodiment of the invention further comprises a threaded section along its exterior, wherein said threaded section is disposed on the exterior of said shotgun choke.

A further embodiment of the invention further comprises a threaded section is disposed at the end of the choke opposite said muzzle break.

A further embodiment of the invention further comprises a first compression zone being further comprised of a cylindrical section, wherein the inner circumference of said first compression zone narrows over the length of said first compression zone.

A further embodiment of the invention further comprises a first stabilization zone is comprised of a cylindrical section of constant circumference being equal to a circumference of a narrow end of said first compression zone.

A further embodiment of the invention further comprises a second compression zone being further comprised of a cylindrical section, wherein the inner circumference of said first compression zone narrows over the length of said second compression zone.

A further embodiment of the invention further comprises a second stabilization zone is comprised of a cylindrical section of constant circumference being equal to a circumference of a narrow end of said second compression zone.

A further embodiment of the invention wherein said muzzle break is substantially aligned with said second compression zone and said second stabilizing zone.

A further embodiment of the invention further comprises a mechanism for attaching said choke to a shotgun barrel, four interior stage chambers, and a muzzle break.

A further embodiment of the invention wherein said mechanism for attaching said choke to a shotgun barrel comprises a threaded zone on the exterior of said shotgun choke for screwing said choke into said shotgun barrel.

A further embodiment of the invention further wherein said muzzle break is further comprised of circular openings.

A further embodiment of the invention wherein said four interior stage chambers comprise: a first zone comprising a first compression stage; a second zone comprising a first stabilizing stage; a third zone comprising a second compression stage; and a fourth zone comprising a second stabilizing stage.

A further embodiment of the invention wherein said first compression stage being further comprised of a cylindrical section, wherein the inner circumference of said first compression stage narrows over the length of said first compression stage.

A further embodiment of the invention wherein said first stabilizing stage is comprised of a cylindrical section of constant circumference being equal to a circumference of a narrow end of said first compression stage.

A further embodiment of the invention wherein said second compression stage being further comprised of a cylindrical section, wherein the inner circumference of said second compression zone narrows over the length of said second compression stage cylindrical section.

A further embodiment of the invention wherein said second stabilizing stage is comprised of a cylindrical section of constant circumference being equal to a circumference of a narrow end of said second compression stage.

A further embodiment of the invention comprises a cylindrical shotgun choke system comprised of a threaded attachment mechanism for attaching said choke to a shotgun barrel; a first stage tapered compression zone with varying diameter, a second stage stabilizing zone with diameter equal to that of a narrower end of said first stage compression zone, a third stage tapered compression zone with a varying diameter with a first diameter equal to that of said second stage stabilizing zone, a fourth stage stabilizing zone of with diameter equal to that of a narrower end of said third stage tapered compression zone; and a muzzle break disposed along the outer shell of said choke being substantially aligned with said fourth stage stabilizing zone and further comprising openings for allowing shot gasses to escape.

DETAILED DESCRIPTION OF EXEMPLARY EMBODIMENTS

Figure 1:
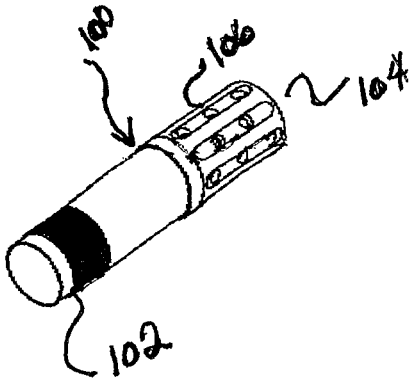
FIG. 1 shows a rear side angled view of an embodiment of the invention.

Turning now to the drawings, where like numbers represent like elements throughout all drawings, it will be understood by one of ordinary skill in the art that this description is made for the purposes of illustration, only, and is not intended to be limiting in any way. It is anticipated that the embodiment described herein may be modified or varied as described and such modifications are contemplated to be encompassed within the appended claims. FIG. 1 is a rendering of an embodiment of the choke apparatus 100 of the invention, substantially cylindrical in shape, from its rear, right side. An embodiment of the choke apparatus 100 includes a threaded section 102 at its attachment end, by which it is engaged with and attached to a shotgun barrel. One of ordinary skill in the art will understand that the choke of an embodiment 100 of the invention will be threaded 102 such that it may be attached to the barrel of any shotgun or barrel manufacturer. The choke of an embodiment of the invention 100 will have a threaded area 102 that is specifically machined for each shotgun or barrel manufacturer. The shot or pellets emerge from the muzzle end 104 after being restricted and compressed into the desired shot stream pattern by the choke of an embodiment of the invention 100. The muzzle end 104 of the choke of an embodiment of the invention 100 also contains a muzzle break 106 such that gasses generated by firing the shotgun shell are released as the shot exits the muzzle end 104 at maximum speed.

Figure 2:
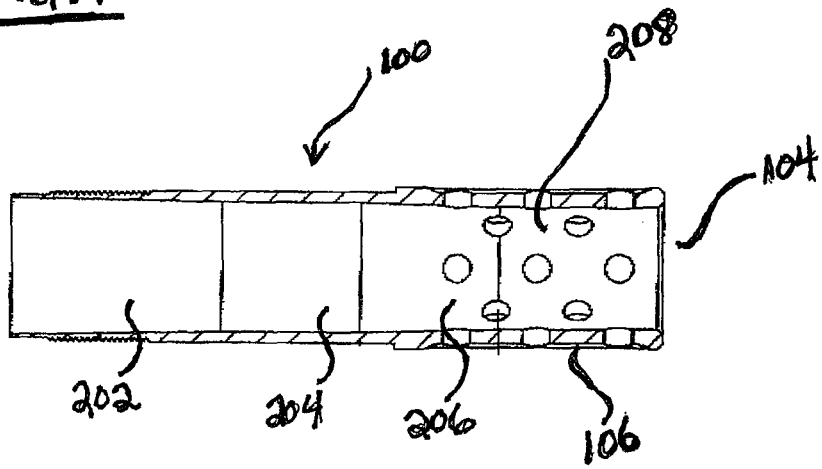
FIG. 2 is a cross-sectional rendering of an embodiment of the invention along its axis.

FIG. 2 is a cross-sectional rendering of the choke of an embodiment of the invention 100 along its horizontal axis. The choke of an embodiment of the invention 100 is composed of four primary areas, or stages, in order: an initial constriction or compression stage 202; a first stabilizing stage 204; a second constriction or compression stage 206; and a fourth stage being a second stabilizing stage 208. In the first compression stage 202 and second compression stage 204, the internal circumference of the cylinder narrows, thereby restricting the area through with the shot may travel through the choke 100. The first stabilizing stage 204 and second stabilizing stage 208 are stepped down and are narrower than the preceding stages. The first stabilizing stage 204 may have the circumference of the end of the first compression stage 202. In the first stabilizing stage 204, the shot "stacks" on top of itself after exiting the first compression stage 202 in the narrower area through which it must travel. The second compression or constriction stage 206 further narrows the circumference of the interior of the choke 100 and reduces the area through which the shot must travel. The ending circumference is the circumference of the fourth and final stage, the second stabilizing stage 208. In the second stabilizing stage 208, or fourth and final stage, the shot is further stacked and packed together. The shot then exits the muzzle end 104 of the choke 100 organized, compressed, and stacked on itself and as it reaches maximum velocity. The muzzle break 106 also allows for the release of gasses as the shot exits the muzzle end 104.

Figure 3:
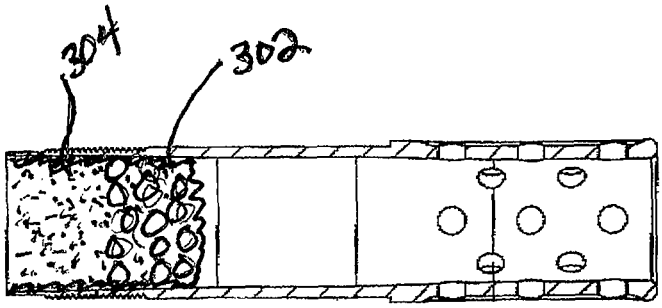
FIG. 3 is a cross-sectional rendering of an embodiment of the invention showing a shot, including wad and shot cup.
Figure 4:
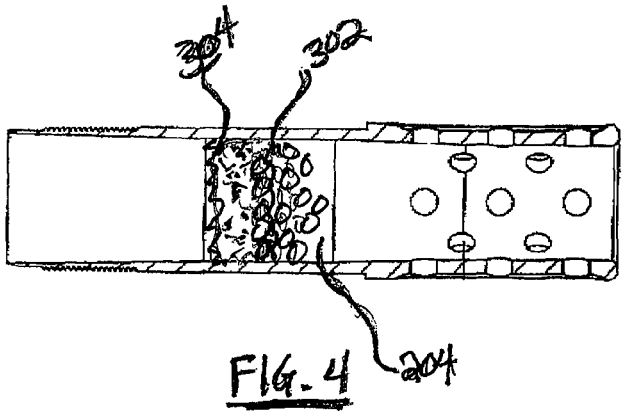
FIG. 4 is a cross-sectional rendering of an embodiment of the invention showing a shot, including wad and shot cup, as it progresses through the embodiment.
Figure 5:
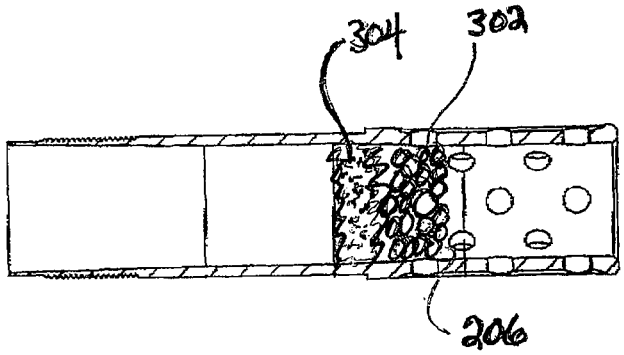
FIG. 5 is a cross-sectional rendering of an embodiment of the invention showing a shot, including wad and shot cup, as it progresses through the embodiment.
Figure 6:
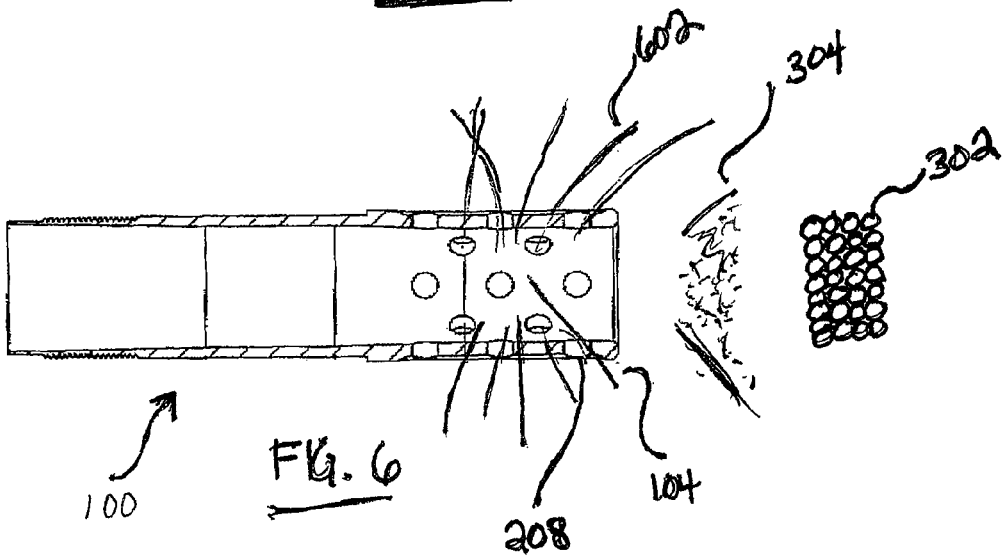
FIG. 6 is a cross-sectional rendering of an embodiment of the invention showing a shot, including wad and shot cup, as it progresses through the embodiment.

FIG. 3 shows the shot package 302 and wad package 304 as they enter the first constriction stage. The first compression stage begins the separation between of the wad package 304 and the shot package 302, which will allow the shot 302 to exit the muzzle end 104 on its own and unencumbered. FIG. 4 shows the shot package 302 and wad package 304 further separating as they enter the first compression or constriction zone 204, and the shot package 302 begins to stack on itself and become more organized. FIG. 5 shows the shot package 302 and wad package 304 in the second compression stage, during which the shot 302 becomes stacked closer together and much more uniform and organized, and the wad package 304 is completely separated from the shot 302. FIG. 6 shows the shot package 302 immediately following its firing from the muzzle end 104 of the choke 100. The shot package 302 is fired packed together and organized into a tight, uniform package. The wad package 304 follows the shot package 302 as a completely separate expulsion from the muzzle end 104. Also shown are the gasses 602 from the firing exiting the muzzle break 208. This configuration, the compacted shot 302 exiting first at maximum speed, and the wad 304 being ejected separately following the shot 302 while gasses 602 escape through the muzzle break 108 significantly reduce the recoil of the shotgun. This configuration also results in 100% of the shot package 302 reaching a target circle of fifteen or twenty inches in diameter over a distance of forty yards, which is a substantial improvement over prior shotgun chokes.

The results of the constriction of embodiment of the choke of the present invention 100 are vast improvements over previous choke systems. An embodiment of a choke of the present invention may place 100% of a shot package of Nitro 457 heavy 12 gauge shot using a Remington 1187 12-gauge shotgun, both manufactured by Remington, within a fifteen (15) inch target circle on a Hunter's Special Turkey Target or Federal Patterning Turkey Target at 40 yards. Significant improvements of shot patterning were experienced as the target was moved, at ten feet increments, up to 80 yards away. It will be appreciated by one of ordinary skill in the art that multiple types of weapons, ammunition, and targets may be used.

A choke of an embodiment of the invention 100 that meets the desired shot patterning characteristics may be 3.563 inches long. The first constriction or compression stage 202 may be 1.125 inches long and may have an interior diameter of 0.740 inches at the beginning of the taper and a diameter of 0.700 inches at the end of the taper. The interior diameter of the first stabilizing zone 204, the second stage of the choke of an embodiment of the invention 100, therefore, may have a diameter of 0.700 inches and may be 0.750 inches long. The third zone, the second compression stage 206, may have a length of 0.813 inches. The second compression stage 206 may have an initial diameter of 0.700 inches in order to taper to a final muzzle diameter of 0.640 inches. The fourth and final stage, the second stabilizing zone 208, therefore, may have an internal diameter of 0.640 inches and has a length of 0.875 inches. The outer diameter of the choke of an embodiment of the present invention 100 at the muzzle break 106 may be 0.875 inches. One of ordinary skill in the art will understand that these dimensions are for descriptive and explanatory purposes only and limited to a single embodiment of the invention and are not for purposes of limitation. One of ordinary skill in the art will further understand that the dimensions above may be modified to fit varying firearm manufacturers and for varying gauges of shotguns. It will be further understood that the final interior muzzle diameter, the interior diameter of the fourth stage, or second stabilizing zone 208, may be of variable size and may be increased by any range of increments, such as by 2.5 100 s of an inch, up to and including a final interior diameter of 0.720 inches. It will be understood that such modifications and variations of the dimensions of the choke of an embodiment of the invention 100 are contemplated by the inventors, expected by the inventors, and will be necessary to accommodate various firearm manufacturers, gauges of firearms, ammunition manufacturers, shot placement and patterning, or any number of variables to reach the desired shot pattern configuration.

It will be understood by one of ordinary skill in the art that the above-described embodiment of the invention is for purposes of explanation, only, and is not intended as limiting this invention to the embodiment described herein. It will be understood that the embodiment described may be constructed of multiple materials so long as they are capable of withstanding the forces and pressures generated by a firing shotgun. One of ordinary skill in the art will understand an appreciate that the choke of the invention 100 has numerous embodiments, limited only by the number of manufacturers of shotguns, shotgun barrels, shotgun gauges, and desired patterning and placement of the shot. One of ordinary skill will also understand and appreciate that the internal dimensions and construction of a choke in accordance with the instant invention may be further determined by the desired shot placement.

What is claimed is:

1. A shotgun choke system for receiving a shot and wad package consisting of a mechanism for attaching the choke to a shotgun barrel, a single continuous cylinder and a muzzle break, said single continuous cylinder consisting of four zones;

a first compression zone consisting of a cylindrical section, wherein the inner circumference of said first compression zone narrows over the length of said first compression zone;

said first compression zone being continuous and integrated with a first stabilization zone, said first stabilization zone consisting of a cylindrical section of constant circumference being equal to a circumference of a narrow end of said first compression zone;

said first stabilization zone being continuous and integrated with a second compression zone, said second compression zone consisting of a cylindrical section, wherein the inner circumference of said second compression zone narrows over the length of said second compression zone;

said second compression zone being continuous and integrated with a second stabilization zone, said second stabilization zone consisting of a cylindrical section of constant circumference being equal to a circumference of a narrow end of said second compression zone;

wherein each compression zone is narrower than the preceding zone allowing for separation of the shot package from the wad package.

2. A shotgun choke for receiving a shot and wad package consisting of a single continuous cylinder, a mechanism for attaching said choke to a shotgun barrel, said single continuous cylinder consisting of four continuous and integrated interior stage chambers, wherein each stage is narrower than the preceding stage allowing for separation of a shot package from a wad package, and a continuous and integrated muzzle break; wherein said four interior stage chambers consist of:

a first chamber consisting of a first compression stage, said first compression stage consisting of a cylindrical section, wherein the inner circumference of said first compression stage narrows over the length of said first compression stage;

a second chamber consisting of a first stabilizing stage, said first stabilizing stage consisting of a cylindrical section of constant circumference being equal to a circumference of a narrow end of said first compression stage;

a third chamber consisting of a second compression stage, said second compression stage consisting of a cylindrical section, wherein the inner circumference of said second compression zone narrows over the length of said second compression stage cylindrical section; and a fourth chamber consisting of a second stabilizing stage, said second stabilizing stage consisting of a cylindrical section of constant circumference being equal to a circumference of a narrow end of said second compression stage.

3. A shotgun choke for receiving a shot and wad package consisting of:

a threaded attachment mechanism for attaching the choke to a shotgun barrel;

a single continuous cylinder consisting of:

a first compression zone consisting of a cylindrical section, wherein the inner circumference of said first compression zone narrows over the length of said first compression zone;

a first stabilization zone continuous and integrated with said first compression zone, said first stabilization zone consisting a cylindrical section of constant circumference being equal to a circumference of a narrow end of said first compression zone;

a second compression tone continuous and integrated with said first stabilization zone, said second compression zone consisting of a cylindrical section, wherein the inner circumference of said second compression zone narrows over the length of said second compression zone;

a second stabilization zone continuous and integrated with said second compression zone, said second stabilization zone consisting of a cylindrical section of constant circumference being equal to a circumference of a narrow end of said second compression zone;

wherein each compression zone is narrower than the preceding zone allowing for separation of the shot package from the wad package; and a muzzle break disposed along the outer shell of said choke being substantially aligned with said second stabilizing zone.

* * * * *